US007880560B2

(12) United States Patent
He et al.

(10) Patent No.: US 7,880,560 B2
(45) Date of Patent: Feb. 1, 2011

(54) DIRECTIONAL COUPLER AND A RECEIVING OR TRANSMITTING DEVICE

(75) Inventors: Pinghua He, Shenzhen (CN); Xinlu Li, Shenzhen (CN); Jianjun Chen, Shenzhen (CN); Zhaolu Wei, Shenzhen (CN); Gang Ju, Shenzhen (CN)

(73) Assignee: Huawei Technologies, Co., Ltd., Shenzhen (CN)

( * ) Notice: Subject to any disclaimer, the term of this patent is extended or adjusted under 35 U.S.C. 154(b) by 0 days.

(21) Appl. No.: 12/505,739

(22) Filed: Jul. 20, 2009

(65) Prior Publication Data

US 2009/0278623 A1 Nov. 12, 2009

Related U.S. Application Data

(63) Continuation of application No. PCT/CN2008/070031, filed on Jan. 7, 2008.

(30) Foreign Application Priority Data

Jan. 18, 2007 (CN) ..... 2007 1 0062806

(51) Int. Cl.
*H01P 5/18* (2006.01)
*H01P 5/08* (2006.01)

(52) U.S. Cl. ..... 333/116; 333/123

(58) Field of Classification Search ..... 333/109, 333/110, 111, 112, 115, 116, 117, 123
See application file for complete search history.

(56) References Cited

U.S. PATENT DOCUMENTS 3,742,393 A 6/1973 Karp
4,211,911 A 7/1980 Dehn
5,281,929 A 1/1994 Willems
5,373,266 A 12/1994 Lenzing et al.
5,974,305 A * 10/1999 Matero ..... 455/188.1
6,392,503 B1 5/2002 Thornton
7,234,948 B2 * 6/2007 Kim et al. ..... 439/76.1

FOREIGN PATENT DOCUMENTS

| | | |
|---|---|---|
| CN | 1555592 | 12/2004 |
| CN | 1860644 | 11/2006 |
| CN | 101009396 | 8/2007 |
| EP | 0228265 A2 | 7/1987 |
| JP | 4026201 | 1/1992 |
| JP | 6132710 | 5/1994 |

* cited by examiner

*Primary Examiner*—Dean O Takaoka
(74) *Attorney, Agent, or Firm*—Leydig, Voit & Mayer, Ltd.

(57) ABSTRACT

A directional coupler and a receiving or transmitting device. The directional coupler includes: a primary signal line composed of a metal rod; and a coupled signal line composed of a microstrip line in a curved shape on a printed circuit board; wherein the medium between the metal rod and the microstrip line is air. Compared with existing directional coupler, the directional coupler of the embodiments of the disclosure has a lower transmitting loss, a large power capacity, and a high directional qualification. The directional coupler is capable of ensuring a higher passive intermodulation qualification. The advantages of the embodiments of the present disclosure are easier assembly, good uniformity of the qualifications, and adaptability for various application environments. The directional coupler of the disclosure ensures different parameter qualifications, and is simple to assemble, so that the low cost is achieved.

20 Claims, 6 Drawing Sheets

DIRECTIONAL COUPLER AND A RECEIVING OR TRANSMITTING DEVICE

CROSS-REFERENCE TO RELATED APPLICATIONS

This application is a continuation of International Patent Application No. PCT/CN2008/070031, filed on Jan. 7, 2008, which claims priority to Chinese Patent Application No. 200710062806.3, filed on Jan. 18, 2007, both of which are incorporated by reference herein their entireties.

FIELD OF THE DISCLOSURE

The present disclosure relates to the communication field and in particular to a directional coupler and a receiving or transmitting device.

BACKGROUND OF THE DISCLOSURE

Couplers are widely used in radio frequency and microwave systems to allocate and integrate signal power and to sample and detect power in a balance device of amplifier, phase shifter, filter, etc. A typical coupler is actually a four-port network dividing an input signal in a specific frequency range into two output signals the power of which is in a specific ratio. There are numerous types of couplers with different natures including a coupling line directional coupler arranged on a Printed Circuit Board (PCB). FIG. 1 illustrates a general structure of a coupling line directional coupler in the prior art. As illustrated in FIG. 1, a primary signal line 11 is provided with two ports, a first port and a third port, and a coupled signal line 12 is also provided with two ports, a second port and a fourth port. When a signal is input from the first port to the primary signal line 11, a coupled signal may be generated on the coupled signal line 12 due to electromagnetic induction and be output from the second and fourth ports.

A weak coupler (with a coupling degree of 30 dB) in the directional coupler is typically used to detect a level of a high-power signal between a Power Amplifier (PA) and an antenna feed system. "Directional" refers to the coupled signal is stronger at the second port than at the fourth port. If the coupling degree of the weak coupler is known, then the level of the input signal at the first port may be calculated simply by detecting the power level of the output signal at the second port. The fourth port is an isolation terminal where a useless signal is output and which is grounded via a match absorption load.

A highly directional (or high-directivity) weak coupler in a wireless access system is primarily used in power detection and standing wave detection circuits of an antenna feed system. FIG. 2 illustrates a block diagram of a circuit of a high-directivity coupler used for antenna feed standing wave detection in the prior art, where resistors R1 and R2 are match resistors. Its detection principle lies in that a forward coupler 21 and a forward power detection circuit 22 detect forward power while a backward coupler 23 and a backward power detection circuit 24 detect backward power, and the difference between the forward power and the backward power is calculated as a return wave loss which is converted into a standing wave of the antenna feed system by a formula. In order to improve a precision of detecting the standing wave of the antenna feed system and hence reduce an error ratio, directivity of the directional coupler has to be improved as much as possible, typically up to 28 dB, and a theoretical derivation thereof is well known in the art and it is not detailed here.

In order to implement high directivity of the weak coupler, it is generally required that the primary signal line and the coupled signal line be arranged in the same medium with an isotropic dielectric constant and magnetic leakage ratio.

If they are not arranged in the same medium, then there may be different phase velocities of odd and even modes (that is, an inappropriate ratio between mutual capacitance and mutual inductance), and in this case, manufacturers may adopt a modified structure to make the phrase phase velocities of the odd and even modes equal, thereby improving directivity. A directional coupler in the prior art is described briefly.

A first prior art relates to a metal rod coupler with the medium of air illustrated in FIG. 3. The medium of air is a medium with a uniform electromagnetic nature, and both a primary signal line 31 and a coupled signal line 32 of the rod-like coupler are arranged in the uniform medium, which results in natural high directivity. As illustrated in FIG. 3, one of two metal rods which is a straight rod acts as the primary signal line while the other U-shaped rod welled on a PCB 33 acts as the coupled signal line, and 301, 302, 304 and 304 denote a first port, a second port, a third port and a fourth port, respectively.

For the metal rod coupler with the medium of air, relative positions of the two metal rods subject to an assembling precision thereof may further influence a coupling degree and a directivity index of the coupler, so that the assembled coupler may suffer from poor consistency of the directivity index and thus has to be connected to an external adjusting element.

A second prior art relates to a hanging wire leap-line coupler shown in FIG. 4*a*. As illustrated in FIG. 4*a*, its primary signal line 41 and coupled signal line 42 are composed of (rod-like) strip lines which are also substantially in the uniform medium of air, thereby resulting in natural high directivity; 401, 402, 404 and 404 denote a first port, a second port, a third port and a fourth port, respectively; and 43 denotes a PCB board.

There is another improved hanging wire leap-line coupler as illustrated in FIG. 4*b* which is different from that in FIG. 4*a* in that the hanging wire is replaced with a metal film resistor 44 inserted through a via hole and the body of the resistor function as a match load of the coupler.

Regardless of the hanging wire leap-line coupler in FIG. 4*a* or the improved hanging wire leap-line coupler in FIG. 4, they enjoy a slightly superior directivity index to that in the first prior art but may still suffer from poor consistency of the directivity index due to an accumulative error of the assembling precision. The coupler with good consistency of the directivity index has to be obtained at a relatively high cost.

A third prior art relates to a microstrip line directional coupler. A primary signal line and a coupled signal line of a conventional strip directional coupler are composed of strips, and the coupler is arranged in a non-uniform medium and thus has a poor directivity index. As illustrated in FIG. 5, the coupled signal line is arranged in a zigzag or wall buttress form to improve the directivity index by making the phase velocities of odd and even modes equal. A power capacity of the microstrip line directional coupler is far below those of the directional couplers in the first and second prior art. Further, the primary signal line of the coupler may suffer from a poor index of Passive Intermodulation (PIM) due to a large number of welding points.

A fourth prior art relates to an existing directional coupler illustrated in FIG. 7 in which a primary signal line is composed of a metal rod and a coupled signal line is composed of a microstrip line on a PCB, which are arranged, typically rectilinearly, in a non-uniform medium. The directional coupler structure in FIG. 7 has advantages of easy assembling and good consistency but may suffer from a poor directivity index of the coupler, approximately 15 dB or worse. Consequently, this coupler may be used only in a power detection circuit but not in a standing wave detection circuit.

Odd and even mode electromagnetic waves (simply referred to as odd and even modes hereinafter) are explained briefly here to facilitate better understanding of the disclosure later.

FIG. 6 illustrates a sectional view of a typical metal rod coupler structure in the prior art in which a backflow ground plane, a primary signal line, a coupled signal line and a backflow ground plane are shown from the top down with the medium of air arranged between the two ground planes. Generally, an odd mode is present between the primary signal line and the coupled signal line and an even mode is present in the entire cavity between the two backflow ground planes.

A phase velocity of either of the odd and even modes is dependent upon the nature of a medium in which the mode propagates. As well known, an electromagnetic wave propagates in the air at the velocity of light, and therefore both the phase velocity of the odd mode and that of the even mode are equal to the velocity of light.

Differently in the scenario of FIG. 7 where the coupled signal line in FIG. 7 is composed of the microstrip line on the PCB, the odd mode is still present in the medium of air and therefore the phase velocity of the odd mode is still approximate to the velocity of light, while a part of the even mode is present in the medium of PCB in which this part of electromagnetic wave propagates slowly and therefore the phase velocity of the odd mode is reduced throughout the system to the extent determined by the value of an equivalent dielectric constant of all the mediums between the two ground planes.

The fast odd mode and the slow even mode may result in the poor directivity index of the coupler, and an increase in the phase velocity of the even mode may be impossible due to the structure of the coupler.

Summarily for above, the directional couplers in the prior art may not be satisfactory in terms of all the parameter indexes such as the directivity index, consistency of the directivity index, the PIM index, the power capacity index, etc., and one or more of the parameter indexes of the existing directional couplers have to be improved in the prior art with a demanding precision and a high cost. Consequently, the parameter indexes of the existing directional couplers may not be improved effectively at a low cost.

SUMMARY OF THE DISCLOSURE

The embodiments of the present disclosure provide a directional coupler and a receiving or transmitting device to guarantee performance indexes of the directional coupler.

A directional coupler includes: a primary signal line composed of a metal rod; a coupled signal line composed of a micro strip; wherein the micro strip is in a curved shape and on a printed circuit board, and the medium between the metal rod and the micro strip is air.

A receiving or transmitting device in a radio frequency or microwave system includes a directional coupler including a primary signal line composed of a metal rod; a coupled signal line composed of a micro strip; wherein the micro strip is in a curved shape and on a printed circuit board, and the medium between the metal rod and the micro strip is air.

The embodiments of the present disclosure in comparison with existing directional couplers may have a low transmission loss, a large power capacity and a superior directivity index, guarantee a good PIM index, be assembled easily, have good consistency of indexes and be adapted to different application scenarios. The above directional coupler may guarantee various parameter indexes and be assembled easily at a low cost.

DETAILED DESCRIPTION OF THE DISCLOSURE

Various embodiments of the disclosure are described in detail below with reference to the drawings.

According to an embodiment of the present disclosure, the phrase velocities of the odd and even modes are substantially equal by decreasing the phrase velocity of the odd mode, thereby improving the directivity index of the coupler.

According to an embodiment of the present disclosure, the phase velocities of the odd and even modes are substantially equal by decreasing the phase velocity of the odd mode, thereby improving the directivity index of the coupler.

Figure 1:
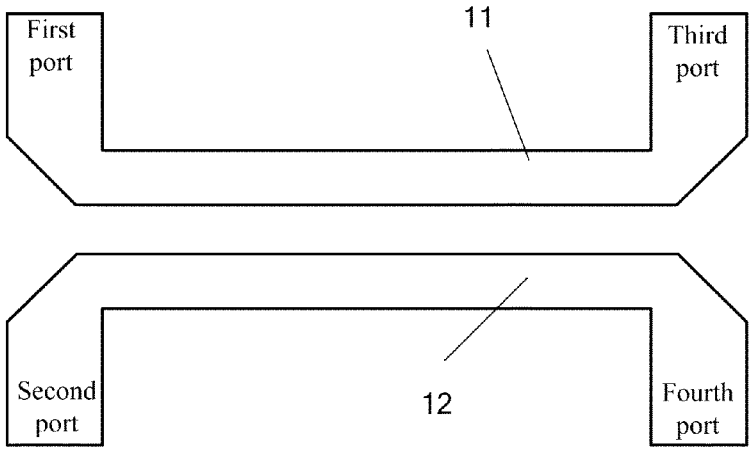
Fig. 1 (Prior Art)
FIG. 1 illustrates a schematic diagram of a general structure of a coupler in the prior art.
Figure 2:
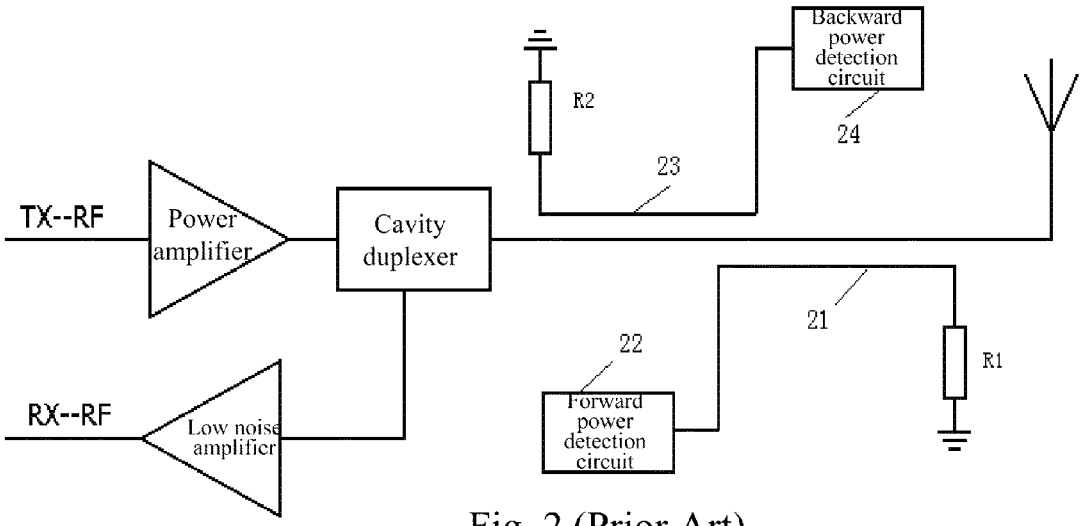
Fig. 2 (Prior Art)
FIG. 2 illustrates a block diagram of a circuit of a high-directivity coupler used for antenna feed standing wave detection in the prior art.
Figure 3:
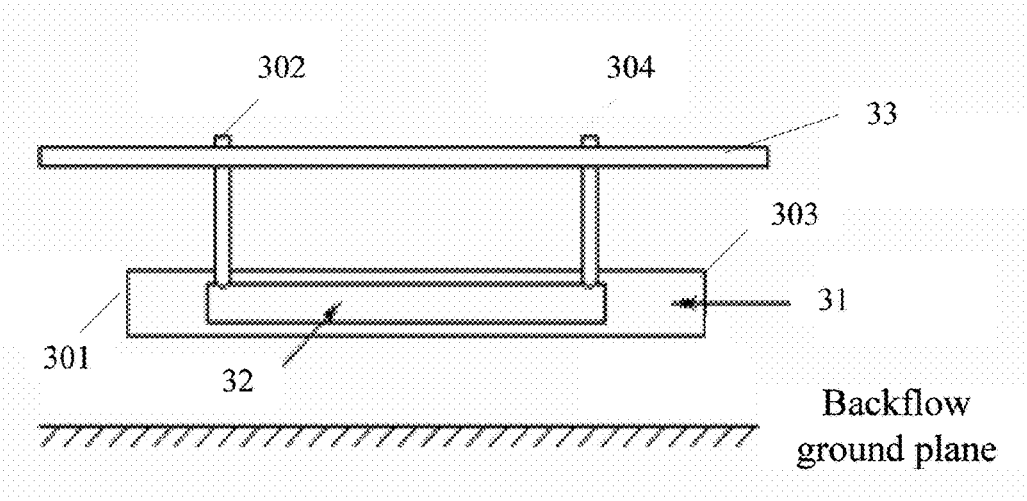
Fig. 3 (Prior Art)
FIG. 3 illustrates a schematic diagram of a structure of a metal rod coupler with the medium of air in the first prior art.
Figure 4A:
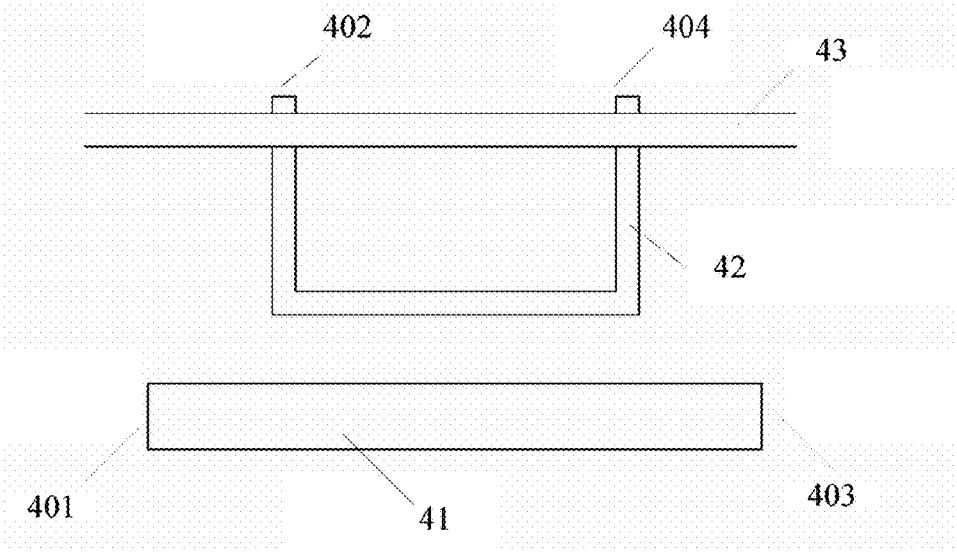
Fig. 4a (Prior Art)
FIG. 4*a* illustrates a schematic diagram of a structure of a hanging wire leap-line coupler in the second prior art.
Figure 4B:
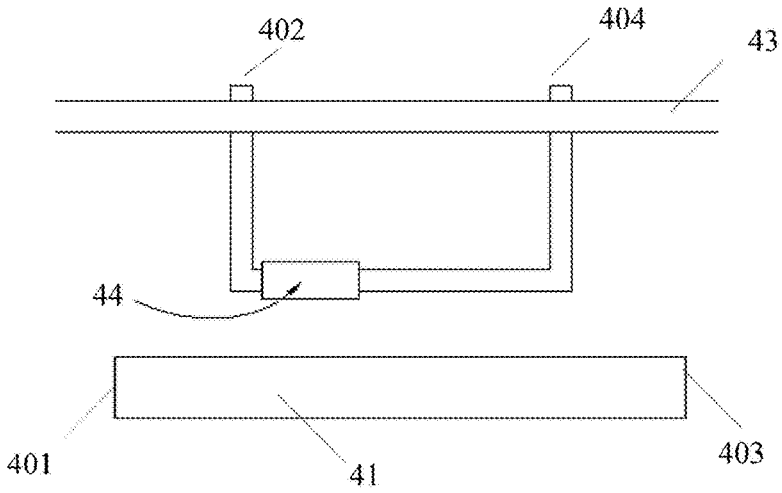
Fig. 4b (Prior Art)
FIG. 4*b* illustrates a schematic diagram of a structure of an improved hanging wire leap-line coupler in the second prior art.
Figure 5:
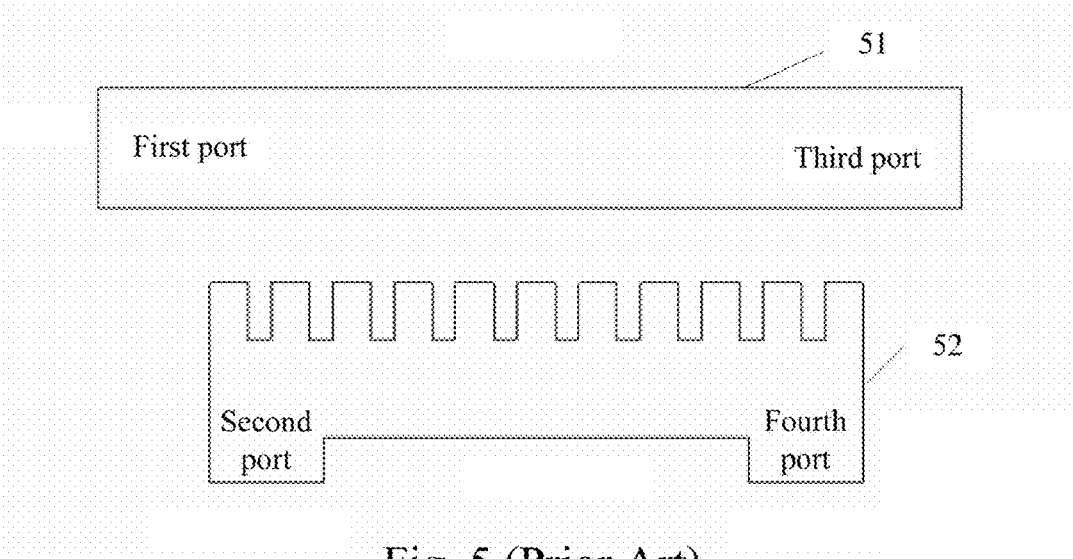
Fig. 5 (Prior Art)
FIG. 5 illustrates a schematic diagram of a structure of a microstrip line directional coupler in the third prior art.
Figure 6:
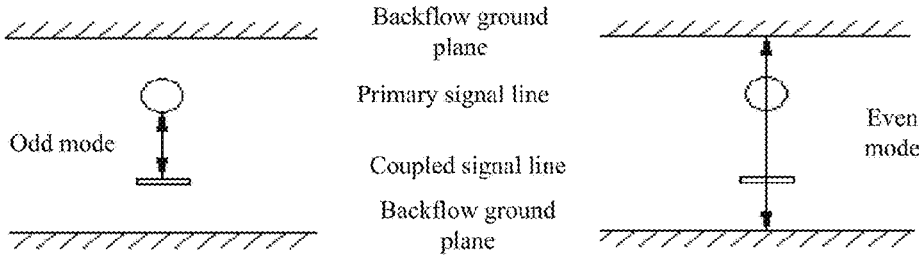
Fig. 6 (Prior Art)
FIG. 6 illustrates a schematic diagram of a sectional view of a structure of a typical metal rod coupler in a uniform medium in the prior art.
Figure 7:
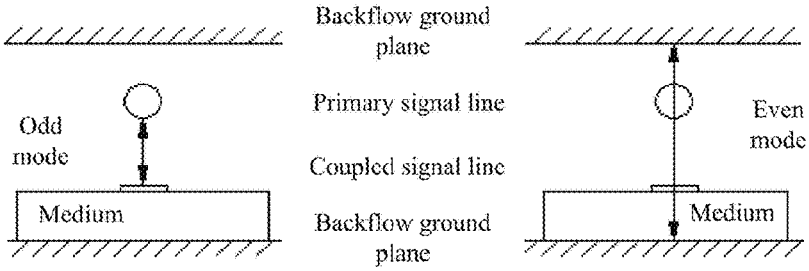
Fig. 7 (Prior Art)
FIG. 7 illustrates a schematic diagram of a sectional view of a structure of a directional coupler in the fourth prior art.
Figure 8:
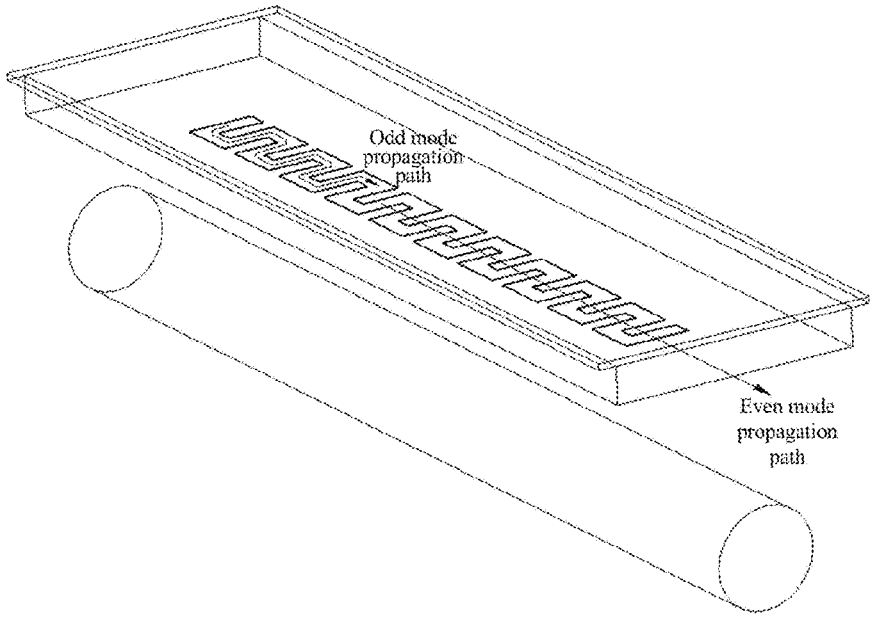
Fig. 8 (Prior Art)
FIG. 8 illustrates a principle schematic diagram of a directional coupler according to the disclosure.

FIG. 8 illustrates a principle schematic diagram of a directional coupler according to an embodiment of the present disclosure. As shown in FIG. 8, the embodiment of the present disclosure makes a coupling microstrip line curved (like a folded line or a smooth curve) so that a path along which the odd mode propagates runs down the curved micro strip microstrip line, and thus the odd mode although propagating at the velocity of light may wriggle. Equivalently, the odd mode propagates in the direction of the primary signal line at a reduced phase velocity.

The phase velocities of the odd and even modes in the direction of the primary signal line may be made substantially equal by adjusting a geometrical size of the curve (e.g. a folded line or a smooth curve), thereby improving the directivity index of the coupler.

Figure 9:
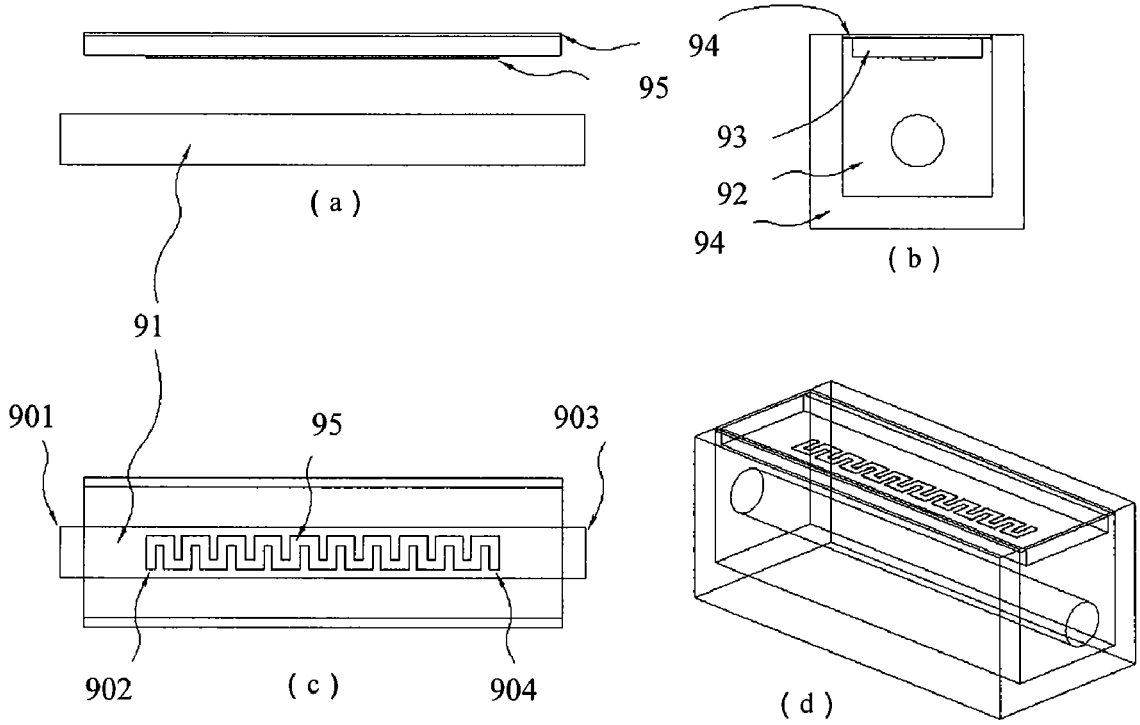
FIG. 9 illustrates a structural diagram of a directional coupler according to an embodiment of the disclosure.

FIG. 9 illustrates a structural view of a structure of a directional coupler according to an embodiment of the present disclosure, where FIG. 9(*a*) to FIG. 9(*d*) are front, side, top and perspective views respectively. For clear illustration of the microstrip line part of the directional coupler, a cavity of the coupler is not shown in the front and top views but is shown only in the side and perspective view, e.g. a ground plane (metal rod backflow) in the side view.

Figure 10:
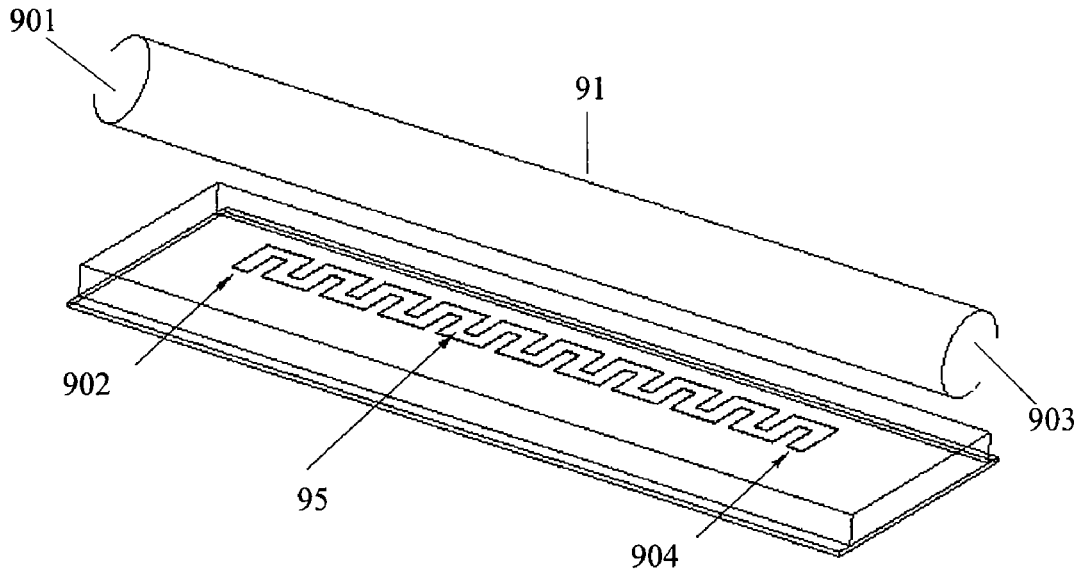
FIG. 10 illustrates a perspective view of a directional coupler according to an embodiment of the disclosure in which no cavity is shown.
Figure 11:
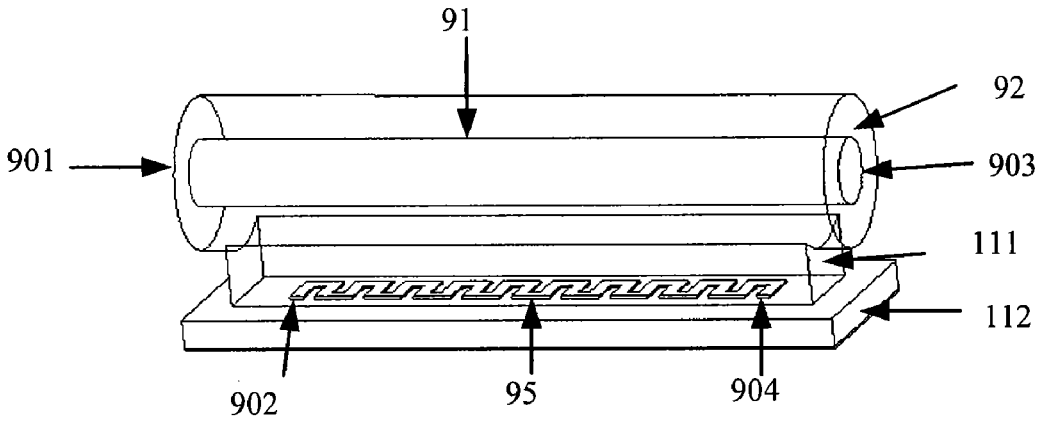
FIG. 11 illustrates a perspective view of a directional coupler according to another embodiment in which a cavity and a window are shown.

FIG. 10 illustrates a perspective view of a coupler according to an embodiment of the present disclosure in which no cavity is shown, and FIG. 11 illustrates a perspective view of a coupler according to an embodiment of the present disclosure in which a cavity is shown. As illustrated FIG. 9, FIG. 10 and FIG. 11, the directional coupler in the embodiments includes a primary signal line and a coupled signal line.

Particularly, the primary signal line (or referred to as a primary signal rod) 91 is composed of a metal rod arranged in the cavity, the air surrounds the metal rod, i.e. the primary signal rod 91, and the inner wall of the cavity is grounded (to provide electric shielding against interference radiation, etc.). As illustrated in FIG. 11, the metal rod, i.e. the primary signal rod 91, is arranged in an air cavity 92. The metal rod and the cavity may or may not be coaxial. 901, 902, 903 and 904 as shown denote the first, second, third and fourth ports respectively, 93 denotes a PCB broad medium and 94 denotes a ground plane. The metal rod, the inner wall of the cavity and the medium of air constitute a general structure of a high-power transmission line. In the embodiment of the present disclosure, the inner wall of the cavity and the exterior of the cavity may be in a shape of cylinder, cuboid, etc., and the metal rod is not limited to a shape of cylinder but also may be in a shape of elliptic cylinder, prism, etc. The cavity structure composed of the metal rod and the grounded inner wall may guarantee a large power capacity and a low transmission loss of the coupler. Furthermore, the organic medium in the PCB may impose substantially no influence on the PIM index of the primary signal rod due to absence of a welding point on the primary signal rod and a considerable distance of the PCB from the primary signal rod in the embodiment of the present disclosure, so that it is possible to guarantee relative superiority of the PIM index.

The coupled signal line is composed of a microstrip line 95 with a grounded reference plane (i.e. a backflow ground plane) 94. The coupled signal line made of the microstrip line results in easy assembling and guarantees a high pattern machining precision and assembling precision and good assembling consistency, thereby achieving good consistency of the parameter indexes.

The microstrip line in this embodiment is arranged in a curved status (e.g. in a shape like a curve of folded, smooth, zigzag, etc., but not limited thereto, and as well known, the coupled signal line curved at the 90 degree occupies the minimum area for the same length thereof), and the phase velocities of the odd and even modes may be made substantially equal by adjusting the pattern parameter of e.g. width, pitch, length, etc., of the folded or smooth curve, or stated in another way, a good directivity index may be achieved by making components of mutual capacitance and mutual inductance in an appropriate ratio.

In this embodiment, the metal rod and the microstrip line are arranged in parallel and non-coplanar planes and in parallel length-wise directions. The entire region (or each of segments) of the folded or smooth curve of the microstrip line is in an electromagnetic coupling relationship with the metal rod. In this embodiment, the primary signal rod is arranged at a position facing the right middle of the coupled signal line (the primary signal rod 91 is right above the coupled signal line 95 as illustrated in FIG. 10), and at this time the coupler may achieve a good performance (or performance-to-price ratio), although the embodiment of the present disclosure is not limited thereto. A slight deviation from the position facing the right middle, e.g. a slight deviation in the transverse direction, of the coupled signal line may not impose noticeable influence on any index.

In this embodiment, the microstrip line is kept in the same shape throughout the coupler for the minimum area, although the embodiment of the present disclosure is not limited thereto.

A window is arranged on the wall of the cavity of the primary signal line 91 in the direction corresponding to the coupled signal line 95 to function as a coupling path between the primary signal line and the coupled signal line. In FIG. 9, the window is arranged in a large size corresponding to that of the cavity in an unapparent way that the shown microstrip line appears visually inside the cavity, while in the schematic diagram of the coupler shown in FIG. 11, there is an apparent window, i.e. a coupling window 111, where 112 in the figure denotes a PCB board.

As can be seen from above, the primary signal line structured with a metal rod in the embodiment of the present disclosure may guarantee the ability of transmitting a high-power signal and a low insertion loss of the coupler as well as superiority of the PIM index due to the absence of a welding point. The coupled line of the coupler in the embodiment of the present disclosure is still made with a metal rod may guarantee the PIM index and the power capacity, and the use of the microstrip line on the PCB for the coupled line may ensure easy assembling and a high positional precision and hence good consistency of the indexes. The printed circuit technologies have been rather mature at present, and a pattern precision may normally be up to 0.03 mm far above an assembling error. Therefore, the high precision of a PCB pattern may avoid the accumulative assembling error in welding and assembling the coupled rod in the first and second prior art, thereby guaranteeing good consistency of the indexes.

In this embodiment, the arrangement of the microstrip line in a curved status may make the phase velocities of the odd and even modes consistent, thereby improving the directivity index of the coupler. An additional advantage of the coupler may lie in that the directional couplers in the prior art are generally of a narrowed and elongated type, while the curved arrangement of the microstrip line in the embodiment of the present disclosure may shorten the length of the coupler and thus facilitate deployment in a microwave device (for a reduction in an occupied area, for example) especially on a PCB. Generally, in the case that an electric length is equal to a quarter of the wavelength, a coupling degree may vary inconspicuously as the frequency varies, while in the case that the electric length is below or above a quarter of the wavelength, the coupling degree may vary conspicuously as the frequency varies so that the coupling degree at a slope may fluctuate in a non-flat way. Therefore, the coupler with an electric length equal to a quarter of the wavelength is referred to as a narrowband coupler. The coupled line in the embodiment of the present disclosure may be made with an electric length equal to a quarter of the wavelength. The electric length equal a quarter of the wavelength may be realized in a region of a relatively short physical length (e.g. one tenth of the wavelength), where the physical length is equivalent to the length of the metal rod and the electric length is equivalent to the total length of the folded microstrip line. When the electric length of the coupled line is a quarter of the wavelength, the coupling degree varies slightly as the frequency varies so that the coupling degree may be made flat in a relatively small coupling region even at a relatively low frequency.

The parameter indexes in this embodiment each are provided with a margin, and therefore there is a considerable degree of freedom available to accommodate different application scenarios. The directivity index among tested indexes of an existing product board may be up to 30 dB and even maximum 50 dB far above a general index required for a product (28 dB).

The above directional coupler may be arranged in a receiving or transmitting device of a radio frequency or microwave system for use in power detection and standing wave detection circuits of an antenna feed system.

The embodiment of the present disclosure improves the three-dimension structure of the existing high-directivity directional high-power weak coupler so that the improved coupler with a good directivity index, good consistency of the index, a good PIM index, a large power capacity and a low transmission loss may be made with a simple structure, at a low cost and with easy assembling.

The above embodiments are provided merely to illustrate but not limit the disclosure. Any modifications, alternatives and adaptation made without departing from the principle of the disclosure shall fall into the scope of the claims appended to the disclosure.

The invention claimed is:

1. A directional coupler, comprising:

a primary signal line composed of a metal rod; and a coupled signal line composed of a microstrip line;

wherein the microstrip line is in a curved shape and on a printed circuit board, a geometrical size of which is adjusted to make phase velocities of the odd and even modes in the direction of the primary signal be substantially equal, and the medium between the metal rod and the microstrip line is air.

2. The directional coupler according to claim 1, wherein the metal rod and the microstrip line are arranged in parallel and non-coplanar planes and in parallel length-wise directions.

3. The directional coupler according to claim 2, wherein the primary signal line is arranged at a position facing the middle of the coupled signal line.

4. The directional coupler according to claim 1, wherein the curved shape comprises a folded or smooth curve shape.

5. The directional coupler according to claim 2, wherein the curved shape comprises a folded or smooth curve shape.

6. The directional coupler according to claim 1, further comprising a cavity with a grounded inner wall, which is arranged around the metal rod.

7. The directional coupler according to claim 6, wherein the inner wall and the exterior of the cavity are in a shape of cylinder or cuboid.

8. The directional coupler according to claim 1, wherein a window is arranged on the cavity to function as a coupling path between the primary signal line and the coupled signal line.

9. The directional coupler according to claim 6, wherein a window is arranged on the cavity to function as a coupling path between the primary signal line and the coupled signal line.

10. The directional coupler according to claim 7, wherein a window is arranged on the cavity to function as a coupling path between the primary signal line and the coupled signal line.

11. The directional coupler according to claim 8, wherein the window is arranged on the cavity in a direction corresponding to the coupled signal line.

12. The directional coupler according to claim 1, wherein the metal rod is in a cylinder shape.

13. A receiving or transmitting device in a radio frequency or microwave system, which comprises a directional coupler comprising:

a primary signal line composed of a metal rod; and a coupled signal line composed of a microstrip line;

wherein the microstrip line is in a curved shape and on a printed circuit board, a geometrical size of which is adjusted to make phase velocities of the odd and even modes in the direction of the primary signal be substantially equal, and the medium between the metal rod and the microstrip line is air.

14. The device according to claim 13, wherein the metal rod and the microstrip line are arranged in parallel and non-coplanar planes and in parallel length-wise directions.

15. The device according to claim 13, wherein the primary signal line is arranged at a position facing the middle of the coupled signal line.

16. The device according to claim 13, wherein the curved shape comprises a folded or smooth curve shape.

17. The device according to claim 14, wherein the curved shape comprises a folded or smooth curve shape.

18. The device according to claim 13, further comprising a cavity arranged around the metal rod, and a window is arranged on the cavity to function as a coupling path between the primary signal line and the coupled signal line.

19. The device according to claim 13, further comprising an antenna feed system and a duplexer, and the primary signal line has one end connected to the antenna feed system and the other end connected to the duplexer.

20. The device according to claim 13, further comprising a power detection circuit and a match resistor, and the coupled signal line has one end connected to the power detection circuit and the other end connected to the match resistor.

* * * * *